US012280862B2

(12) United States Patent
Frouin

(10) Patent No.: US 12,280,862 B2
(45) Date of Patent: Apr. 22, 2025

(54) PROPULSION SYSTEM INTENDED TO BE INTEGRATED INTO A BOAT

(71) Applicant: BLUENAV, Arcachon (FR)

(72) Inventor: Hervé Frouin, Arcachon (FR)

(73) Assignee: BLUENAV, Arcachon (FR)

( * ) Notice: Subject to any disclaimer, the term of this patent is extended or adjusted under 35 U.S.C. 154(b) by 526 days.

(21) Appl. No.: 17/675,074

(22) Filed: Feb. 18, 2022

(65) Prior Publication Data

US 2024/0158062 A1 May 16, 2024

(30) Foreign Application Priority Data

Feb. 18, 2021 (FR) ..... 2101586

(51) Int. Cl.
*B63H 21/17* (2006.01)
*B63H 5/125* (2006.01)
*B63H 21/21* (2006.01)

(52) U.S. Cl.
CPC ..... *B63H 21/17* (2013.01); *B63H 5/125* (2013.01); *B63H 21/21* (2013.01); *B63H 2005/1258* (2013.01)

(58) Field of Classification Search
CPC ..... B63H 21/00; B63H 21/17; B63H 21/21; B63H 5/00; B63H 5/125; B63H 2005/1258; B63H 21/12; B63H 25/00; B63H 25/46
USPC ..... 440/6
See application file for complete search history.

(56) References Cited

U.S. PATENT DOCUMENTS 2,156,938 A 5/1939 Edwards
2,987,027 A * 6/1961 Wanzer ..... B63H 25/42 440/58
5,522,335 A 6/1996 Veronesi et al.
6,458,004 B2 * 10/2002 Van Breems ..... B63H 5/1252 440/6
9,796,462 B2 * 10/2017 Conesa Gracia ..... B63H 5/125

FOREIGN PATENT DOCUMENTS

EP 2463195 A1 6/2012
EP 3395669 A1 10/2018
IT 201800010227 A1 5/2020

* cited by examiner

*Primary Examiner* — Lars A Olson
(74) *Attorney, Agent, or Firm* — Greer, Burns & Crain, Ltd.

(57) ABSTRACT

The invention relates to a propulsion system (30) intended to be integrated into a boat (1) and comprising a vertical guide device (31) comprising a member for fixing the vertical guide device (31) to the hull of said boat (1); an electric thruster (32) comprising a gyration box (33), said gyration box (33) being vertically movably mounted on the vertical guide device (31) to be able to adopt an emerged position and a submerged position; a drive system (34) capable of causing a vertical movement of the gyration box (33) of the electric thruster (32) along the guide device (31); a control unit (35) capable of receiving a movement instruction and arranged, in response to said instruction, to control the drive system (34) to cause movement of the gyration box (33) toward the emerged position or toward the submerged position.

7 Claims, 3 Drawing Sheets

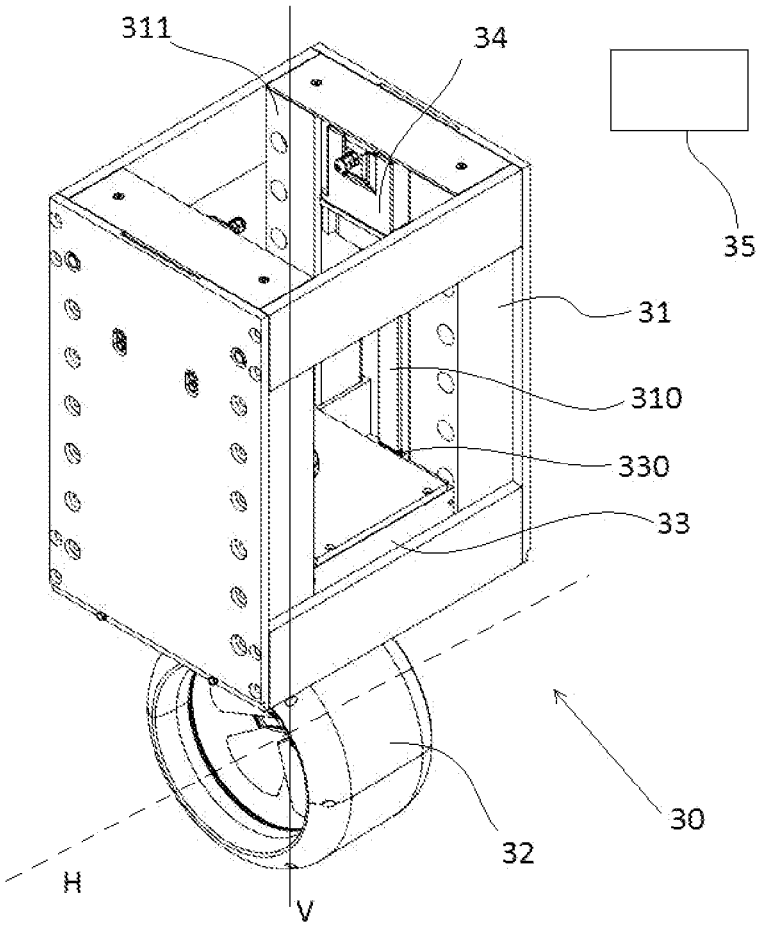
[Fig. 1]

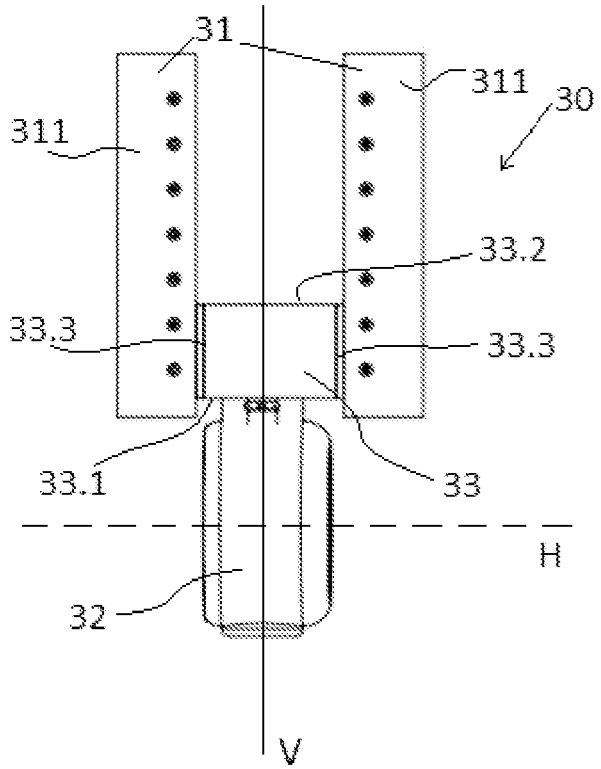
[Fig. 2]
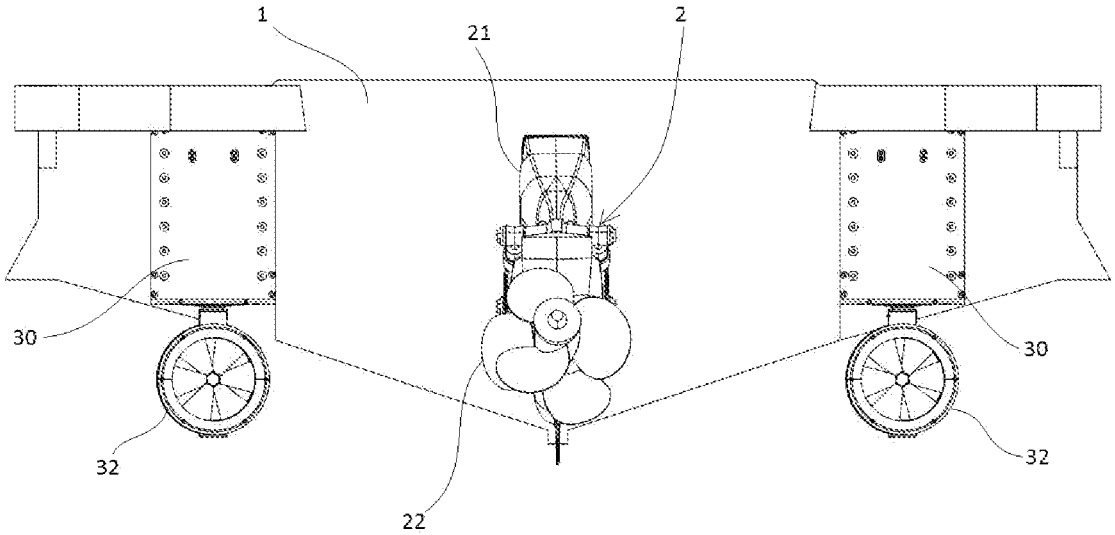
[Fig. 3]

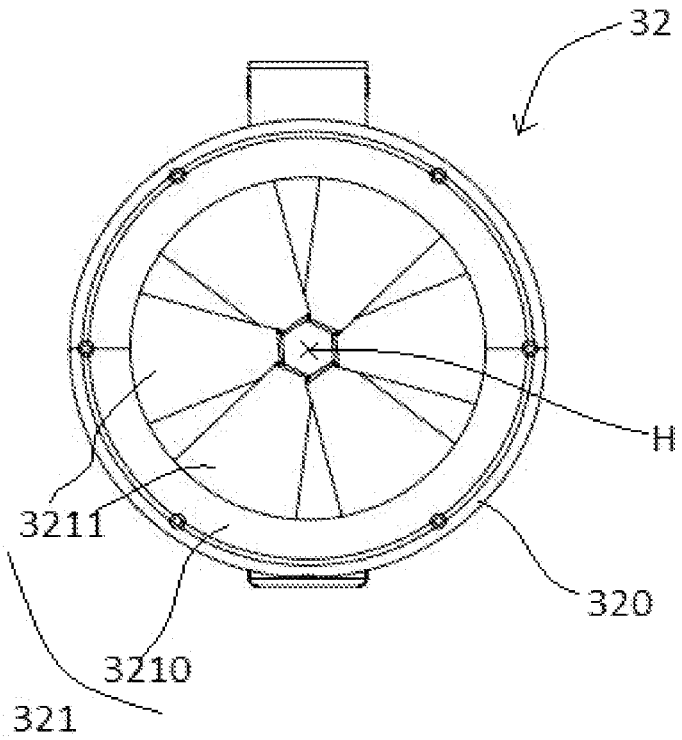
[Fig. 4]

PROPULSION SYSTEM INTENDED TO BE INTEGRATED INTO A BOAT

This application claims the benefit of priority from French Patent application FR 101586 with the filing date of Feb. 18, 2021, the entire disclosure of which is herein incorporated by reference.

TECHNICAL FIELD

The subject of the invention is an electric propulsion system intended to be integrated into a boat.

The invention relates to the technical field of boat propulsion systems.

STATE OF THE ART

In the field of boats, it is known to use heat engines for their propulsion. Although these engines deliver significant power allowing navigation at high speed, they are polluting and noisy. It is also known to equip a boat with electric thrusters in order to reduce its ecological impact. This type of thruster overcomes the drawbacks of the heat engine by being clean and silent; however, given the weight of a boat, the electrical energy consumption of this type of thruster requires high-capacity batteries, which are potentially expensive.

In order to retain the advantages of each of these types of propulsion while eliminating their drawbacks, it is known to equip a boat with both a heat engine and an electric thruster, one or the other being activated depending on the navigation mode chosen by the pilot of the boat. However, in order to equip an existing boat with this type of hybrid propulsion, it is necessary to modify essential elements of the boat's structure in order to be able to install a heat engine and an electric motor that can each drive the same propeller of the boat. For example, it is necessary to move the original heat engine in order to interface the propeller of the boat with both the heat engine and the electric motor. This type of modification is complex and expensive. In addition, this modification may appear risky in the eyes of the owner of the boat, insofar as the structure of his boat is affected, and may encourage him not to proceed with the installation of the electric motor.

The invention falls in this context and one objective of the invention is to propose an electric propulsion system capable of being integrated into a boat that is already equipped with a heat engine in order to form, with this heat engine, a hybrid propulsion system able to operate selectively in a thermal mode or in an electric mode, without requiring significant modification of the structure of the boat.

Invention Summary.

The subject of the invention is a propulsion system intended to be integrated into a boat comprising a vertical guide device comprising a member for fixing the vertical guide device to the hull of said boat; an electric thruster comprising a gyration box, said gyration box being vertically movably mounted on the vertical guide device to be able to adopt an emerged position and a submerged position, a drive system capable of causing a vertical movement of the gyration box of the electric thruster along the guide device; a control unit capable of receiving a movement instruction and arranged, in response to said instruction, to control the drive system to cause movement of the gyration box toward the emerged position or toward the submerged position.

The propulsion system according to the invention may be added, using the fixing member, to a boat already equipped with thermal propulsion. The thermal propulsion of the boat associated with the propulsion system according to the invention may therefore become a hybrid system. The addition of the propulsion system to the boat is possible while avoiding modification of the essential structural elements of the boat, in particular because the system is equipped with its own electric thruster and therefore does not require interfacing with the propeller driven by the motor of the thermal thruster. The costs of integrating the propulsion system are therefore reduced and it is easy to add it to a new boat as well as to an old boat. The propulsion system according to the invention may therefore serve as a complement to thermal propulsion, the assembly forming a hybrid system that is able to operate in a thermal mode when the electric propulsion is in the emerged position or in an electric mode when the electric propulsion is in the submerged position. It is the control unit that advantageously acts as the relay between the instructions given by the navigator and the drive system of the gyration box of the electric thruster, allowing the electric thruster to be lowered or raised.

The fixing member may advantageously be a screw fastener, a weld or an adhesive bond. Advantageously, the propulsion system is integrated at the rear of the boat, for example under bathing platforms. Advantageously, the guide device is arranged above the waterline.

Advantageously, the gyration box comprises an upper face, a lower face, a front face, a rear face and two side faces. The electric thruster is mounted on the underside of the gyration box. The gyration box driven by the vertical device may advantageously be moved into a high position and a low position, so that the electric thruster is in an emerged or submerged position. The guide device advantageously allows the gyration box to be placed in the submerged position or in the emerged position.

Advantageously, the vertical guide device comprises a transmission member, the drive system comprises at least one motor able to drive the transmission member in rotation and the gyration box comprises a complementary transmission member cooperating with the transmission member so that the rotation of the transmission member causes a vertical movement of the complementary transmission member.

Advantageously, the transmission member may be a worm capable of being driven in rotation by the motor, and the complementary transmission member may be a nut mounted on the worm. The worm may for example be mounted in rotation about a vertical axis, in a rail of the guide device In another embodiment, the transmission member and the complementary transmission member may be a rack and at least one gear. The additional transmission member may be provided on one of the side faces of the gyration box. Preferably, the motor is a stepper motor.

Advantageously, the vertical guide device comprises two transmission members arranged on either side of the electric thruster and the gyration box comprises two complementary transmission members each cooperating with one of said transmission members, in that the drive system comprises two stepper motors each able to drive one of the transmission members in rotation, and the control unit is arranged, in response to said instruction, to control each of the stepper motors to cause a simultaneous vertical movement of each of the complementary transmission members.

Advantageously, each transmission member is driven by a stepper motor. In this case, the control unit drives the two stepper motors so that the vertical movements of each of the complementary transmission members are simultaneous. In an alternative embodiment, the drive system comprises a stepper motor controlling the two transmission members and the two complementary transmission members. For example, the guide device comprises two rails, the gyration box being arranged between these two rails. Where applicable, each of the two transmission members is provided on one of the side faces of the gyration box, each being installed in one of the rails, on either side of the gyration box.

Advantageously, the electric thruster is rotatably mounted on the gyration box along a vertical axis, the drive system is able to cause rotation of the thruster about said vertical axis, and the control unit is arranged, in response to said instruction, to control the drive system to cause rotation of the thruster to a determined position according to said instruction.

The rotation advantageously allows the orientation of the electric thruster to be changed and therefore allows the orientation of the navigation to be changed. Thus, the propulsion system according to the invention may act as a transverse propulsion. This type of propulsion system can facilitate anchoring maneuvers, for example in a port or for mooring to a deadman when there is current. For example, the electric thruster may adopt a position parallel to the navigation or, for example, a position perpendicular to the navigation. In another example, the electric thruster may be rotated to pass from the submerged position to the emerged position or vice versa.

Preferably, the gyration box is fixed in rotation relative to the guide device, the electric thruster thus being capable of pivoting relative to the guide device.

Advantageously, the control unit is arranged, in response to an instruction to move the thruster toward an emerged position, to control the drive system to cause rotation of the thruster toward a predetermined position.

When the instruction received by the control unit is to move the propulsion from the submerged position to the emerged position, the control unit pilots the drive system to advantageously allow the thruster to turn toward a predetermined passage position to the emerged position, before driving the drive system to cause the gyration box to move toward the emerged position. This predetermined position is that allowing the guide device to place the gyration box in the emerged position. If the thruster is not in this predetermined position, the emerged position of the gyration box is impossible. It is therefore advantageously the vertical translation position of the electric thruster. The rotation of the electric thruster relative to the gyration box is possible only when the gyration box is in the submerged position on the guide device.

In another embodiment, this predetermined position may also correspond to a rest position in which the thermal propulsion is stopped, for example waiting to be put into operation or waiting to be put in the emerged position.

Advantageously, the control unit is arranged, in response to an instruction to move the thruster to a given angular position, to control the drive system to cause the thruster to rotate toward a determined position according to said instruction.

According to this feature, the thruster thus adopts a given angular position according to the instruction given by the navigator and received by the control unit. The angular position of the thruster may for example depend on the angle of orientation that the pilot wishes to impart to the boat.

Advantageously, the electric thruster is capable of pivoting about said vertical axis according to an angular range in particular of 360°, in particular of 180°. In other words, the electric thruster is capable of pivoting about said vertical axis by 180° and in particular by 90° on either side of said predetermined position Advantageously, the thruster is rotatably mounted on the gyration box along said vertical axis via a reduction gear and in that the drive system comprises a motor capable of driving said reduction gear.

If desired, the motor may be a DC motor. In one example, the reduction gear may be a pinion driven by the motor and meshed with a toothed wheel, the electric thruster possibly being equipped with a shaft extending along said vertical axis and driven by said toothed wheel. The cooperation of the motor with the reduction gear causes the rotation of the electric thruster on its vertical axis.

Advantageously, the electric thruster comprises a motor comprising a stator and a rotor, the rotor comprising a propeller comprising a plurality of blades mounted on a crown, the motor being arranged to cause rotation of the crown with respect to the stator.

According to one example, the electric thruster comprises the propeller provided with a crown forming a rotor, the electric motor and an annular stator that surrounds the crown of the propeller. The stator and the rotor thus face one another in the radial direction of the propeller. The propeller and the stator are advantageously arranged coaxially, the central axis of the stator and that of the crown being coincident with the axis of the propeller. The crown is rotatable about the axis of the propeller with respect to the stator. When the electric motor is put into operation following an instruction received from the control unit, the rotation of the rotor causes the simultaneous rotation of the blades and the crown.

Advantageously, the plurality of blades is mounted on the crown concentrically to rotate about the axis of the propeller. Preferably, each blade extends radially from the crown toward the axis of the propeller. Where appropriate, each blade may comprise an outer end fixed to the crown, on the stator side, and a free inner end, on the side of the propeller shaft. Advantageously, the thruster may have no hub connecting the inner ends of the blades. The absence of a hub may allow the use of a compact thruster, the length of which may be adapted to be inserted into the vertical guide device while maintaining a power similar to that of a thruster comprising a hub connecting the inner ends of the blades.

If desired, each blade may have a substantially triangular shape. Each blade may be a flat plate, or perhaps a curved plate.

The electric motor may be a permanent magnet-type DC motor. Alternatively, the rotor may be a cylindrical salient pole rotor that comprises a plurality of salient poles spaced in the circumferential direction of the propeller. The electric motor may be a switched reluctance motor. Without being limited to these types of motors, the electric motor may be a DC motor with a brush, or perhaps a brushless motor, or perhaps another type of motor.

The electric motor may perform clockwise rotation and counterclockwise rotation. When the electric motor rotates the rotor in the clockwise direction, the propeller also rotates in the clockwise direction, and a thrust force in the forward direction is generated. On the contrary, when the electric motor rotates the rotor in the counterclockwise rotation direction, the propeller also rotates in the counterclockwise rotation direction, and a thrust force in the reverse direction, that is to say, in the opposite direction, is generated.

In one embodiment of the invention, the propulsion system may comprise a fin, or a lift flap of the boat, that is able to adopt a deployed position and a folded position, and an actuator capable of causing movement of the fin or the lift flap, to one or the other of these deployed and folded positions. If necessary, the control unit may be capable of receiving a correction instruction and arranged, in response to said instruction, to control the actuator to cause movement of the fin, or of the lift flap, toward the deployed position or the folded position. For example, said fin or said lift flap may be mounted, by means of a hinge, on a side face of the guide device, the actuator being arranged to fold said fin or said lift flap against said side face or to deploy said fin or said lift flap from said side face.

Another aspect of the invention relates to a boat equipped with a thermal propulsion system and a propulsion system comprising an electric thruster.

BRIEF DESCRIPTION OF THE DRAWINGS

Other advantages and features of the present invention are now described using examples that are purely illustrative and in no way limit the scope of the invention, and based on the appended drawings, in which drawings the various figures show:

FIG. 1 shows, schematically and partially, a perspective view of a propulsion system according to one embodiment of the invention;

FIG. 2 shows, schematically and partially, a front view of the propulsion system of [FIG. 1];

FIG. 3 shows, schematically and partially, a rear view of a part of a hull of a boat on which two propulsion systems are fixed according to one embodiment of the invention; and FIG. 4 shows, schematically and partially, a front view of an electric thruster of a propulsion system according to one embodiment of the invention.

In the following description, identical elements, by structure or by function, appearing in different figures retain the same references, unless otherwise specified.

DETAILED DESCRIPTION

[FIG. 1] shows a propulsion system 30 according to one embodiment of the invention. This propulsion system 30 is described in connection with [FIG. 2], [FIG. 3] and [FIG. 4].

The propulsion system 30 comprises a vertical guide device 31 and an electric thruster 32 comprising a gyration box 33. The propulsion system 30 has two positions, an emerged position (not shown) and a submerged position.

The example of [FIG. 3] shows a boat 1 according to one embodiment of the invention. This boat 1 is equipped with a thermal thruster 2 comprising a heat engine 21 and a propeller 22, and two propulsion systems 30, arranged on either side of the thermal thruster 2. As shown in [FIG. 3], each propulsion system 30 is fixed to the rear of the hull of the boat 1, under a bathing platform. The set of electric 30 and thermal 2 thrusters forms a hybrid propulsion system, the pilot of the boat 1 being able to selectively activate a thermal propulsion mode or an electric propulsion mode.

The propulsion system 30 comprises an electric propulsion 32 shown in [FIG. 4], subsequently called electric thruster. The electric thruster 32 comprises a motor comprising a stator 320 and a rotor 321. This motor is a brushless motor. The rotor 321 comprises a crown 3210 on which a plurality of blades 3211 are fixed that form a propeller rotating about a propeller axis H coinciding with the axis of rotation of the rotor 321. The stator 320 surrounds the rotor 321. Each blade 3211 extends radially from the crown 3210, to which it is fixed, toward the axis H. Each blade 3211 has a substantially triangular shape. Each blade has an outer end located on the side of the stator and an inner end located on the side of the propeller shaft. The outer end of each blade 3211 is fixed to the crown 3210 and the inner end of each blade 3211 is free, the rotor 321 thus having no central hub. When the motor is started, the rotation of the rotor causes the simultaneous rotation of the blades 3211 and the crown 3210.

The propulsion system 30 comprises two drive systems 34. In the example described, each drive system 34 comprises a stepper motor.

The vertical guide device 31 comprises two opposite rails 311, inside which transmission members 310 are provided. Each drive system 34 is arranged in one of the rails 311. In the embodiment described in [FIG. 1], each transmission member 310 is a worm, mounted vertically along an axis parallel to a vertical axis V passing through the electric thruster 32, in one of the rails 311 and connected to one of the drive systems 34. Each drive system 34 allows driving of the rotation of the worm 310 of the guide device 31.

The gyration box 33 is installed between the two rails of the guide device 31. The gyration box 33 of the electric thruster 32 comprises an upper face 33.2, a lower face 33.1 and two side faces 33.3. The gyration box 33 comprises, on each of its side faces 33.3, a complementary transmission member 330 each cooperating with one of the transmission members 310. In the example described, each complementary transmission member 330 is a nut secured to a side face 33.3 of the gyration box 33 and screwed onto the worm 310. When the drive systems 34 are activated, they each drive a worm 310 in rotation and therefore cause the movement of each nut 330 on these worms 310, and consequently the movement of the gyration box 33 along the vertical guide device 31.

The guide device 31 allows the vertical movement of the gyration box 33 and therefore of the electric thruster 32 in an emerged position (not shown) and/or in a submerged position.

The electric thruster 32 is mounted on the underside 33.1 of the gyration box 33. The gyration box 33 is fixed in rotation with respect to the vertical axis V. The electric thruster 32 is rotatably mounted about the vertical axis V, relative to the gyration box 33. The drive system 34 comprises a motor and a pinion meshed with a toothed wheel (not shown and provided inside the gyration box 33). The electric thruster 32 has a shaft extending along the vertical axis V. The shaft of the electric thruster cooperates with the toothed wheel; thus, the motor of the drive system 34 allows the rotation of the electric thruster 32 about the vertical axis.

The propulsion system 30 comprises a control unit 35 capable of receiving a movement or gyration instruction from a cockpit of the boat, for example under the impetus of the pilot of the boat. In response to the instruction, the control unit 35 is arranged to control the drive system 34 to cause a vertical movement of the gyration box 33 in an emerged or submerged position and/or a rotation of the electric thruster 32 about the axis V according to the instruction received.

When the pilot activates the electric propulsion mode, the control unit 35 receives an instruction to move the electric thruster to the submerged position and, in response to this instruction, controls the drive system 34. The drive system 34 activates the two stepper motors of the guide device 31, which simultaneously rotate each worm 310 on which each nut 330 descends. The gyration box 33 passes from an emerged position to a submerged position. The electric thruster 32 is in a predetermined angular position in which the position of the gyration box 33 may be modified by the vertical guide device 31. It should be noted that in this position, the rotation of the electric thruster 32 about the axis V is authorized. If we compare [FIG. 2] and [FIG. 3], the electric thruster 30 is able to pivot in rotation about the vertical axis V through an angle of 90° on either side of this predetermined angular position.

When the pilot wishes to perform a transverse maneuver, the control unit 35 receives an instruction to move the electric thruster 32 to a given angular position, for example 90°, and controls the drive system 34 in response to this instruction. The drive system 34 activates the motor driving the pinion, the toothed wheel and the shaft of the electric thruster 32, causing the rotation of the electric thruster 32 corresponding to the determined amplitude.

When the navigator deactivates the electric propulsion mode to return to a thermal propulsion mode, the control unit 35 receives an instruction to move the electric thruster to the emerged position and controls the drive system 34 in response to this instruction. The drive system 34 activates the motor driving the pinion, the toothed wheel and the shaft of the electric thruster 32, causing the rotation of the electric thruster 32 in the predetermined position. The drive system 34 activates the two stepper motors of the guide device 31, which simultaneously rotate each worm 310 on which each nut 330 rises. The gyration box 33 passes from a submerged position to an emerged position.

The preceding description clearly explains how the invention allows the objectives it has set itself to be achieved, namely to propose an electric propulsion system capable of being integrated into a boat already equipped with a heat engine in order to form a hybrid propulsion system with this heat engine, able to operate selectively in a thermal mode or in an electric mode, without requiring significant modification of the structure of the boat, by proposing a propulsion system intended to be integrated into a boat equipped with thermal propulsion, comprising a vertical guide device, an electric thruster, a drive system and a control unit.

In any event, the invention cannot be limited to the embodiments specifically described in this document, and extends in particular to all equivalent means and to any technically operative combination of these means.

The invention claimed is:

1. A propulsion system (30) intended to be integrated into a boat (1) and comprising:

a) A vertical guide device (31) comprising a member for fixing the vertical guide device (31) to the hull of said boat (1);

b) An electric thruster (32) comprising a gyration box (33), said gyration box (33) being vertically movably mounted on the vertical guide device (31) to be able to adopt an emerged position and a submerged position, wherein the electric thruster (32) rotates when moving from the submerged position to the emerged position or vice versa, said electric thruster (32) is rotatably mounted on the gyration box (33) along a vertical axis (V);

c) A drive system (34) capable of causing a vertical movement of the gyration box (33) of the electric thruster (32) along the guide device (31);

d) A control unit (35) capable of receiving a movement instruction and arranged, in response to said instruction, to control the drive system (34) to cause movement of the gyration box (33) toward the emerged position or toward the submerged position; and wherein the drive system (34) is able to cause rotation of the thruster (32) about said vertical axis (V), and wherein the control unit (35) is arranged, in response to said instruction, to control the drive system (34) to cause rotation of the thruster (32) toward the emerged position from the submerged position or vice versa according to said instruction.

2. The propulsion system (30) according to claim 1, characterized in that the vertical guide device (31) comprises a transmission member (310), in that the drive system (34) comprises at least one motor able to drive the transmission member (310) in rotation and in that the gyration box (33) comprises a complementary transmission member (330) cooperating with the transmission member (310) so that the rotation of the transmission member (310) causes a vertical movement of the complementary transmission member (330).

3. The propulsion system (30) according to claim 2, characterized in that the vertical guide device (31) comprises two transmission members (310) arranged on either side of the electric thruster (32), in that the gyration box (33) comprises two complementary transmission members (330) each cooperating with one of said transmission members (310), in that the drive system (34) comprises two stepper motors each able to drive one of the transmission members (310) in rotation, and in that the control unit (35) is arranged, in response to said instruction, to control each of the stepper motors to cause a simultaneous vertical movement of each of the complementary transmission members (330).

4. The propulsion system (30) according to claim 1, characterized in that the control unit (35) is arranged, in response to an instruction to move the thruster (32) toward a given angular position, to control the drive system (34) to cause rotation of the thruster (32) toward a determined position according to said instruction.

5. The propulsion system (30) according to claim 1, characterized in that the thruster (32) is rotatably mounted on the gyration box (33) along said vertical axis (V) via a reduction gear and in that the drive system (34) comprises a motor capable of driving said reduction gear.

6. The propulsion system (30) according to claim 5, characterized in that the electric thruster (32) comprises a motor comprising a stator (320) and a rotor (321), the rotor (321) comprising a propeller comprising a plurality of blades (3211) mounted on a crown (3210), the motor being arranged to cause rotation of the crown (3210) with respect to the stator (320).

7. A boat (1) equipped with a thermal propulsion system (2) and a propulsion system (30) according to claim 1.

* * * * *